US008262806B2

(12) United States Patent
Collin et al.

(10) Patent No.: US 8,262,806 B2
(45) **Date of Patent: *Sep. 11, 2012**

(54) LOW-PRESSURE SLUDGE REMOVAL METHOD AND APPARATUS USING COHERENT JET NOZZLES

(75) Inventors: Jean Collin, Herndon, VA (US); Ryan Jones, Herndon, VA (US); Joshua Luszcz, Falls Church, VA (US); Marc Kreider, Herndon, VA (US); Aaron Pellman, Reston, VA (US); Robert D. Varrin, Jr., Reston, VA (US); David Arguelles, Washington, DC (US)

(73) Assignee: Dominion Engineering, Inc., Reston, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/108,627

(22) Filed: May 16, 2011

(65) Prior Publication Data

US 2011/0271986 A1 Nov. 10, 2011

Related U.S. Application Data

(62) Division of application No. 11/771,755, filed on Jun. 29, 2007, now Pat. No. 7,967,918.

(60) Provisional application No. 60/817,350, filed on Jun. 30, 2006.

(51) Int. Cl.

| | |
|---|---|
| ***B08B 3/00*** | (2006.01) |
| ***B08B 3/12*** | (2006.01) |
| ***B08B 6/00*** | (2006.01) |

(52) U.S. Cl. ..... 134/34; 134/43; 134/167 R; 134/172; 134/174

(58) Field of Classification Search ..... 134/34, 134/43, 167 R, 172, 174

See application file for complete search history.

(56) References Cited

U.S. PATENT DOCUMENTS

| | | | |
|---|---|---|---|
| 4,498,427 | A | 2/1985 | Todd |
| 4,566,406 | A | 1/1986 | Appleman |
| 4,715,324 | A | 12/1987 | Muller et al. |
| 4,887,555 | A | 12/1989 | Smet |
| 5,555,851 | A | 9/1996 | Vandenberg |
| 5,782,255 | A | 7/1998 | Magnin et al. |
| 5,794,854 | A | 8/1998 | Yie |
| RE38,542 | E | 7/2004 | Ashton et al. |

*Primary Examiner* — Michael Barr
*Assistant Examiner* — Charles W Kling
(74) *Attorney, Agent, or Firm* — Pillsbury Winthrop Shaw Pittman LLP

(57) ABSTRACT

Provided area cleaning apparatus and an associated method of using the disclosed apparatus wherein the apparatus utilizes one or more nozzles configured to provide a coherent stream of one or more cleaning fluids for removing accumulated fine particulate matter, sludge, from surfaces. The nozzles may be sized, arranged and configured to provide coherent streams that maintain the initial stream diameter for a substantial portion of the maximum dimension of the space being cleaned. The apparatus and method are expected to be particularly useful in the cleaning of heat exchangers incorporating a plurality of substantially vertical and narrowly spaced tubes by directing cleansing streams along a plurality of intertube spaces.

19 Claims, 12 Drawing Sheets

LOW-PRESSURE SLUDGE REMOVAL METHOD AND APPARATUS USING COHERENT JET NOZZLES

PRIORITY STATEMENT

This application is a divisional application of U.S. Ser. No. 11/771,755, which was filed on Jun. 29, 2007 now U.S. Pat. No. 7,967,918, and claims priority under 35 U.S.C. §119(e) to U.S. Provisional Patent Application No. 60/817,350, which was filed on Jun. 30, 2006, the entire contents of both of which are incorporated herein, in their entirety and for all purposes, by reference.

BACKGROUND

1. Field of Endeavor

This invention relates to methods and apparatus for cleaning debris in confined areas including, for example, heat exchangers having vertically arranged tube arrays and, more particularly to methods and apparatus for removing sludge deposits from the tube sheets of steam generators using low-pressure, high-flow coherent fluid jets.

2. Description of the Conventional Art

In nuclear power plants, steam generators serve as large heat-exchangers for generating steam which is used for driving turbines. A typical steam generator has a vertically oriented outer shell containing a plurality of inverted U-shaped heat-exchanger tubes disposed therein to collectively form a tube bundle. The U-shaped tubes are commonly arranged in a triangular-pitch or square-pitch tube array to form interstitial gaps, or "intertube lanes," that are typically from about 2.5 mm to 10 mm (about 0.1 to 0.4 in.) wide. In most steam generator designs, a centrally located, untubed region extending longitudinally along the central vertical axis of the steam generator is defined by the elongated portions of the innermost U-shaped tubes. This untubed region is typically about 10 cm (4 in.) wide and may be referred to as the "no-tube" lane.

A plurality of horizontally oriented upper annular tube support plates are provided at periodic intervals for arranging and supporting the U-shaped tubes. Each tube support plate typically contains a triangular- or square-pitch array of holes or openings therein for accommodating the elongated portions of the U-shaped tubes. The height of the U-shaped tubes may exceed 9.75 m (32 ft), and a conventional steam generator will typically include six or more tube support plates, with each tube support plate being horizontally disposed along the tube path with adjacent tube support plates typically having a vertical separation of 0.9 to 1.5 m (3 to 5 foot) intervals.

A tube sheet spaced below the lowermost tube support plate separates a lower primary side from an upper secondary side of the steam generator. A dividing plate cooperates with the lower face of the tube sheet to divide the primary side into an entrance plenum for accepting hot primary coolant from the nuclear core and an exit plenum for recycling lower temperature primary coolant to the reactor for reheating. The entrance and exit plenums are connected through the tube sheet by the U-shaped tubes.

Primary fluid that is heated by circulation through the core of the nuclear reactor enters the steam generator through the entrance plenum. The primary fluid is fed into the U-shaped tubes, which carry the primary fluid through the secondary side of the steam generator. A secondary fluid, generally water, is concurrently introduced into the secondary side of the steam generator and circulated through the interstitial gaps between the U-shaped tubes. Although isolated from the primary side fluid in the U-shaped tubes, the secondary fluid comes into fluid communication with the outer surface of the U-shaped tubes thereby transferring heat from the primary fluid to the secondary fluid. This heat transfer, in turn, converts a portion of the secondary fluid into steam that is then removed from the top of the steam generator in a continuous steam cycle. The steam is subsequently circulated through standard electrical generating equipment. The cooled primary side fluid exits the steam generator through the exit plenum, where it is returned to the nuclear reactor for reheating.

Under normal operation of a nuclear power plant, impurities such as iron and copper are transported to the steam generators via the secondary side feed water system. These impurities accumulate as scales on the outer diameter of steam generator tubing, as well as sludge, which settles on the upper surfaces of the tube support plates and on the tube sheet. These sludge and scale accumulations can lead to many unwanted side-effects including accelerated degradation of steam generator tubing and other internal components, and decreased heat transfer efficiency. As a result, it is desirable to periodically remove these sludge and scale accumulations in order to maintain steam generator cleanliness, integrity and performance.

The most commonly used method for removing the sludge collected on the tube sheet of steam generators is referred to as sludge lancing. Sludge lancing methods use high-pressure, for example 5.2-27.6 MPa (750-4,000 psi), water jets to dislodge the sludge. These water jets work in conjunction with corresponding suction and filtration equipment for removing and disposing of the sludge dislodged by the high-pressure water jets. In practice, these high-pressure water jets are directed into the 2.5 to 10 mm (0.1 to 0.4 in.) intertube lanes to dislodge and flush sludge that settles in the interstitial gaps formed between the tubes. The sludge-laden water is subsequently collected by suction equipment that may, in turn, be operatively connected to a filtration/recirculation system that may be used to separate the sludge from the sludge-water mixture for disposal.

Two principal types of lancing devices are used to clean steam generators in conventional cleaning operations. The first, and probably more common, type of lancing device comprises a high-pressure lance that is installed through access ports provided in the steam generator shell opposite both ends of the no-tube lane. This high-pressure lance is then used to dislodge sludge from within the tube bundle and flush sludge to the steam generator periphery where it is then collected and removed from the steam generator using suction equipment. As discussed in Hickman et al.'s U.S. Pat. No. 4,079,701, the efficiency of sludge collection at the steam generator periphery can be enhanced by establishing a circumferential flow around the tube bundle that will tend to direct sludge toward the suction equipment once it is flushed from the tube array boundary and reaches the steam generator periphery.

The second type of lancing device, sometimes referred to as an "outside-in" device, comprises a high-pressure lance that is installed through an access port in the annulus between the tube bundle and the steam generator shell. This lance is used to dislodge and flush sludge from the steam generator periphery toward the no-tube lane, or toward another region of the steam generator annulus, where the dislodged sludge may be collected and removed by suction equipment.

To some extent, both types of sludge lance devices described above are capable of removing soft, highly mobile sludge accumulations, which collect on the tube sheet in steam generators. However, the sludge removal efficiency of these devices is typically reduced by lateral scattering of the dislodged sludge. In particular, the high-pressure water jets used to dislodge sludge characteristically result in some lateral scattering of the dislodged sludge into areas of the tube array that have already been cleaned, rather than effectively flushing the sludge toward suction equipment intake. As a result, multiple passes and long application times are typically required to achieve satisfactory cleaning levels, even when the majority of the sludge present on the tube sheet is soft and highly mobile, i.e., is not highly adherent and/or consolidated.

As discussed in Lahoda et al.'s U.S. Pat. No. 4,676,201, this lateral scattering effect may be reduced when the height of the sludge pile on the tube sheet is about one inch or higher because sludge present in adjacent intertube lanes limits the spread of sludge and water from the intertube lane being processed. As a result, sludge lancing works well for reducing the height of large sludge piles (10 to 15 cm) (four to six inches deep, or more) to smaller sludge piles (2.5 cm deep, or less) (1 in. deep, or less). However, complete removal of these smaller sludge piles by sludge lancing is difficult due to a greater tendency for the high-pressure water jets to scatter the dislodged sludge into previously cleaned areas.

Because most nuclear power plants now operate with better water chemistry control, fewer impurities are transported to the steam generators during plant operation. However, even with good water chemistry control, small piles of sludge can accumulate on the tube sheet in the steam generators. If an All Volatile Treatment (AVT) chemistry is employed, the majority of the sludge that accumulates on the tube sheet within the steam generator will typically comprise soft, silt-like particulates. However, over time this soft, highly mobile sludge can harden/consolidate and form more tenacious deposits, i.e., hard sludge, often referred to as tube sheet "collars."

High-pressure lancing techniques, however, have proven to be somewhat less effective for removing these more tenacious deposits. Indeed, chemical cleaning techniques and/or more aggressive mechanical cleaning techniques are typically required to remove the majority of these more tenacious deposits. As a result, many utilities are interested in removing these smaller piles, for example, deposits having a depth of about 2.5 cm or less (about 1 inch or less) of soft sludge before they consolidate, and would prefer to use a method or apparatus that is more efficient for removing small piles of soft, highly mobile sludge than available high-pressure water lancing techniques.

As discussed in Lahoda et al.'s U.S. Pat. No. 4,676,201 and Muller et al.'s U.S. Pat. No. 4,715,324, attempts to increase the efficiency of high-pressure sludge lancing techniques have led to modifications of several lancing devices to include both high-pressure water jet(s) for dislodging sludge and "barrier" jet(s) for preventing redeposition of scattered sludge in areas that have already been cleaned. However, there are several additional disadvantages associated with these modified designs. Specifically, the high-pressure water jet and the barrier jet in the apparatus described in the Lahoda et al.'s U.S. Pat. No. 4,676,201, the contents of which are hereby incorporated, in its entirety, by reference, are typically separated by a gap of at least two columns of tubes. This gap allows any sludge scattered by the high-pressure water jet to collect between the two jets, resulting in subsequent scattering by the barrier jet.

In the method described in the Muller et al.'s U.S. Pat. No. 4,715,324, the contents of which are hereby incorporated, in its entirety, by reference, the high-pressure water jet and low-pressure water jet are operated in an alternating manner, rather than simultaneously. As a result, little, if any, reduction in lateral scattering or increase in sludge removal efficiency is achieved by this method. Similarly, cleaning operations using this technique do not tend to result in little, if any, reduction in the number of passes or required application time would be expected. The shortcomings associated with the modified lancing devices described in both the Lahoda et al.'s U.S. Pat. No. 4,676,201 and Muller et al.'s U.S. Pat. No. 4,715,324, is reflected in the failure of devices according to these disclosures to achieve wide use within the industry and the continued widespread reliance on previous generation lancing devices.

BRIEF SUMMARY

Example embodiments of the invention provide, for example, improved methods, apparatus and systems for removing loose debris in confined spaces including, for example, sludge that collects on the tube sheet of steam generators.

Example embodiments of the invention include, for example, low-pressure sludge removal methods which reduce the lateral scattering of dislodged sludge into areas that have already been cleaned, thereby increasing the sludge removal efficiency relative to conventional high-pressure lancing techniques. As a consequence, equivalent or improved removal of mobile sludge and/or other loosely bound debris can be achieved in fewer passes, in less time and without the hazards and specialized equipment associated with high-pressure lancing techniques.

Example embodiments of the invention include, for example, a range of apparatus that may be configured for practicing low-pressure sludge removal methods according to the invention. With respect to nuclear applications, for example, the low-pressure operation of the apparatus allows for installation completely within the containment building. Conversely, the conventional high-pressure lancing techniques typically require the staging of high-pressure pumps, filtration equipment, and a majority of the recirculation lines outside the containment building. The ability to install required equipment completely inside the containment building further reduces time commitment and logistical support required during setup, operation, and teardown of the low-pressure sludge removal apparatus according to the invention.

Example embodiments of the invention include, for example, apparatus in which the incorporated pumps and filtration equipment are compatible with and can be incorporated into conventional recirculation systems configured for use in other chemical and mechanical cleaning processes. Such conventional systems are typically used, for example, in steam generator cleaning operations including, for example, conventional steam generator chemical cleaning, Advanced Scale Conditioning Agent (ASCA) soaks, and Ultrasonic Energy Cleaning (UEC). These alternative cleaning techniques are often utilized for removing or structurally modifying tenacious deposits, e.g., scale or hard sludge, that tend to form on the surfaces of the tube sheet, tubing, and other components within the steam generators as a result of consolidation and/or hardening of the initial loose sludge (as discussed above) and/or deposit of dissolved minerals. The effectiveness of these techniques, however, is often compromised or degraded by the overlying layer of softer silt-like sludge that will interfere with the transfer of chemical treatment compositions and/or ultrasonic energy into the underlying hard sludge or tube sheet "collars."

As a result, the low-pressure sludge removal method of the current invention can be applied prior to these chemical and mechanical cleaning techniques in order to quickly and efficiently remove piles of soft, highly mobile sludge, and thereby enhance the effectiveness of these subsequent chemical and mechanical cleaning techniques. Conventional high-pressure lancing techniques have typically not been performed prior to the chemical and mechanical cleaning techniques discussed above due to the longer application time required and the reduced compatibility of high-pressure lancing equipment (e.g., pumps, filtration and recirculation equipment, etc.) with the recirculation systems used during these chemical and mechanical cleaning processes.

As yet an additional consequence of the foregoing object, the opposing nozzles used in the low-pressure sludge removing apparatus can be separated by an angle of less than 180°, which facilitates continuous cleaning operation on both sides of the no-tube lane. In contrast, opposing nozzles are typically separated by 180° in apparatus used during conventional high-pressure lancing techniques, such that reaction forces associated with the opposing nozzles offset, and no excessive lift force is imposed on the lance. Unfortunately, this conventional design typically directs the high-pressure water jets provided on one side of the no-tube lane away from the tube sheet while cleaning is being performed on the other.

Example embodiments of the invention include low-pressure cleaning apparatus including a cleaning fluid distribution shuttle configured for insertion along a no-tube lane; a first plurality of low-pressure nozzles and a second plurality of low-pressure nozzles, both operably connected to the cleaning fluid distribution shuttle, wherein each individual low-pressure nozzle is configured to produce a coherent fluid jet; and wherein the carriage is configured for providing both linear movement of the cleaning fluid distribution shuttle in a direction parallel to a main longitudinal axis of the cleaning fluid distribution shuttle, and rotational movement about a rotational axis parallel to the main axis.

Other embodiments of the invention as described herein include low-pressure cleaning apparatus, in which the nozzles are configured for producing a coherent fluid jet at a pressure of no more than 2.1 MPa and in which each nozzle may also be configured for producing a coherent fluid jet exhibiting a flow of at least 15 liters/min. As will be appreciated by those skilled in the art, the utilization of low-pressure nozzles allows for a variety of nozzle configurations including those in which a single row of nozzles extends along a portion of the cleaning fluid distribution shuttle and those in which the nozzles are arranged in two or more rows that are separated by an angle Φ, for example, an angle from about 90° to about 180°, such that coherent fluid jets can simultaneously ejected from both sides of the cleaning fluid distribution shuttle into intertube lanes arranged on opposite sides of the no-tube lane. As will be appreciated by those skilled in the art, the nozzle arrays directed to opposite sides of the no-tube lane may be offset from the other array to compensate for differences in the arrangement, spacing and orientation of the tubes or members on opposite sides of the no-tube lane.

As will also be appreciated by those skilled in the art, the nozzles may be provided with valves that provide for selective control over the flow of the cleaning fluid through a particular nozzle or group of nozzles. This additional level of control may be used to increase the flow rate through selected nozzles by reducing or terminating the flow through the unselected (or deselected) nozzles. Similarly, the flow through one or more nozzles directed into shorter intertube gaps can terminated as the end of the intertube gap is reacted and thereby prevent or suppress interference with a separate circumferential flow. Further, although it is anticipated that in many applications a common fluid source will be used to supply the cleaning fluid to all of the nozzles, there may be instances in which one or more of the nozzles is configured to receive a different cleaning fluid, thereby allowing additional control of the cleaning process.

The cleaning fluid distribution shuttle may be moved along the no-tube lane using a variety of mechanisms, including manual, semi-automatic and fully automatic indexing mechanisms for controlling carriage movement to align the low-pressure nozzles with targeted intertube lanes. The cleaning fluid distribution shuttle may also be associated with one or more mechanisms for controlling the rotational movement of the shuttle and its attached nozzles to "sweep" the cleaning fluid from, for example, a proximal portion of the intertube lane adjacent the no-tube lane, to, for example, a distal portion of the intertube lane, and thereby tend to force silt and other sediment toward the peripheral region of the steam generator.

For those instances in which the nozzles are provided on at least two cleaning fluid distribution channels, the rotating and/or oscillating units may be operated independently and/or in a synchronized manner to increase the efficiency of the cleaning process. For example, two or more rotating or oscillating units may be arranged in a vertical configuration with their movements synchronized to provide a coordinated initial wash and a secondary wash down a single intertube lane and thereby increase the efficiency of the cleaning process.

The nozzles incorporated in the cleaning apparatus are configured for producing a coherent flow, i.e., a flow that has a reduced tendency to spread and can maintain an average diameter or maximum dimension that is commensurate with the initial average diameter over a useful distance. For example, a coherent flow having an initial average width of $W_e$ and a final average width $W_m$ measured at a maximum cleaning distance, may exhibit a spread on the order of 20-30%, as reflected by the expression $1.2\ W_e \leqq W_m$ in the case of a spread of 20% (or less). As will be appreciated by those skilled in the art, the initial dimensions of the coherent flow may be matched more closely to the intertube lane dimensions, thereby allowing most of the intertube lane to be exposed to a more uniform cleansing stream.

As will also be appreciated by those skilled in the art, the width and length of the intertube lanes may vary widely, but may be defined by an aspect ratio (L/D) that will reflect the relative challenges of a particular configuration. For example, those configurations having a relatively lower aspect ratio may be cleaned effectively with a cleansing stream having a correspondingly lower degree of coherence while those configurations having higher aspect ratios will tend to require cleansing streams having a correspondingly higher degree of coherence in order that the distal portions of the tube lane will still receive sufficient flow. The coherence of the flow may be expressed as a ratio of the initial stream dimensions and the stream dimensions at some designated distance from the nozzle exit.

In order to account for the variations among the flow configurations, the designated distance may be expressed as a multiple of one of an initial dimension or dimensions of the stream, for example, the diameter of a generally circular stream, is within predetermined dimensional limits. Similarly, the maximum cleaning distance, e.g., the distance at which the cleansing flow exits the intertube lane, can also be expressed as a multiple of one of an initial dimension or dimensions of the stream. It is contemplated that coherent streams ejected from nozzles according to the invention can exhibit a satisfactory degree of coherence over a distance of at least 100 times the initial diameter of a generally circular stream.

As reflected in certain of the attached Figures, nozzles according to example embodiments of the invention may have a wide variety of configurations to provide cleansing streams that are, for example, generally circular, elongated in the vertical direction or elongated in a horizontal direction, to adapt the configuration of the stream more closely to cleaning requirements and dimensions of an intertube lane. As reflected in the Figures, regardless of the configuration, nozzles according to the invention will include a plurality of closely spaced orifices that have a width that accounts for only a fraction of the total stream width. The sub-streams issuing from each of these orifices will, in turn, coalesce into a single, coherent stream.

Methods for cleaning surfaces within a tube array according to the invention will typically include introducing a cleaning apparatus into an opening provided adjacent the regular array; aligning a coherent flow nozzles provided on the cleaning apparatus with intertube lanes (or, more broadly, intermember lanes) defined between two adjacent rows of the vertical tubes, passages or members; ejecting coherent jets of a cleaning solution through the coherent flow nozzles; and sweeping the stream from a proximal portion of the intermember lane to a distal portion of the intermember lane, thereby removing material from the intermember lane.

Variations of these basic methods according to example embodiments of the inventions may further include ejecting the cleaning solution from the coherent flow nozzles at a pressure of, for example, no more than about 2.1 MPa and at a flow rate of, for example, 15 liters/min. or more. Example embodiments of methods according to the invention may also include steps and mechanisms for aligning the coherent flow nozzles with the intermember lanes by detecting at least one of the intermember lane and a member adjacent the intermember lane using a sensor selected from a group consisting of optical sensors, mechanical sensors, ultrasonic sensors and capacitive sensors. The step of aligning the coherent flow nozzles with the intermember lanes may also include adjusting a separation spacing between adjacent coherent flow nozzles to correspond to a characteristic pitch defined by the regular array. Depending on the configuration of the vessel, additional nozzles, providing either conventional or coherent flow, may be arranged to promote a circumferential flow along at least a portion of the periphery of the heat exchanger and/or steam generator vessel that helps direct cleaning streams exiting the tube array and the associated silt and debris toward a removal point, typically a vacuum port, for removing the cleansing solution and any entrained or dissolved silt or debris from the steam generator.

BRIEF DESCRIPTION OF THE DRAWINGS

Example embodiments of the methods that may be utilized in practicing the invention are addressed more fully below with reference to the attached drawings in which.

Figure 1:
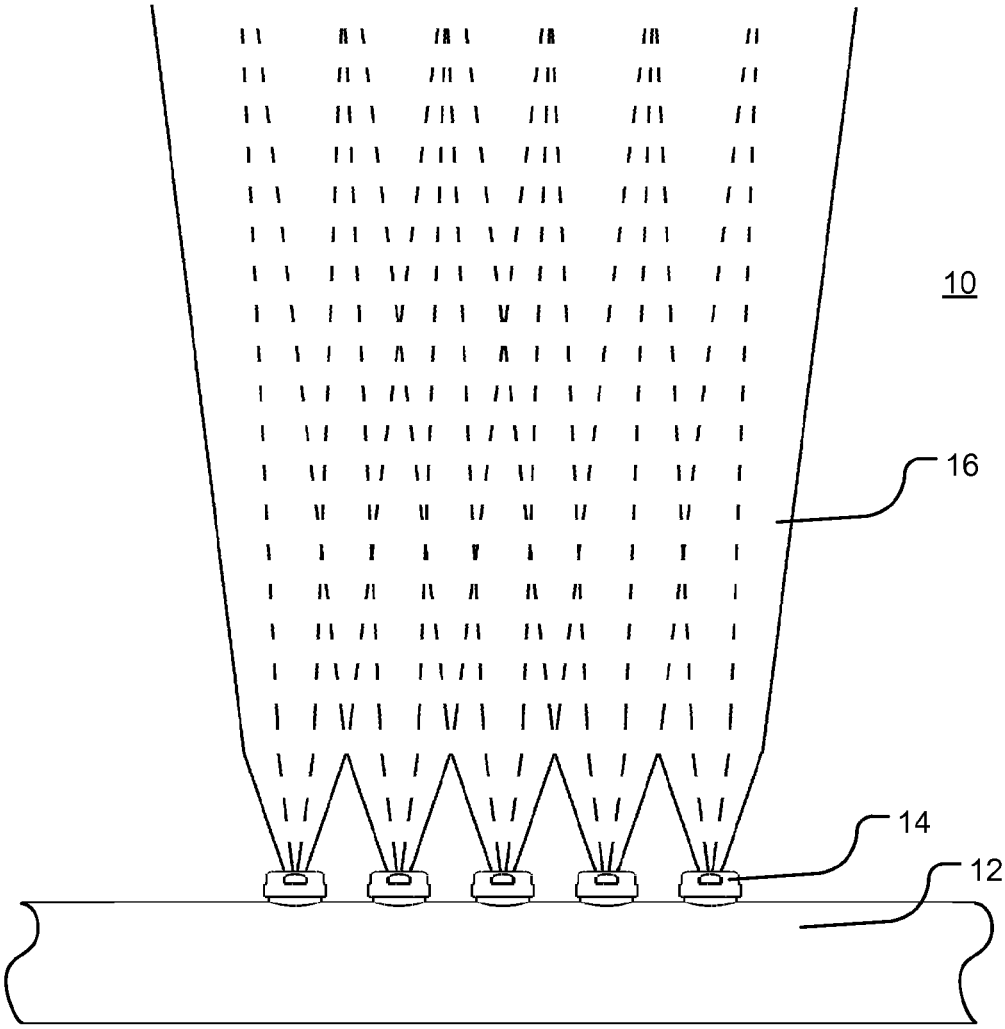
FIG. 1 illustrates a diffusing flow pattern exhibited by conventional nozzles.

It should be noted that these figures are intended to illustrate the general characteristics of methods and materials with reference to certain example embodiments of the invention and thereby supplement the detailed written description provided below. These drawings are not, however, to scale and may not precisely reflect the characteristics of any given embodiment, and should not be interpreted as defining or limiting the range of values or properties of embodiments within the scope of this invention. In particular, the relative sizing and positioning of particular elements and structures may be reduced or exaggerated for clarity. The use of similar or identical reference numbers in the various drawings is intended to indicate the presence of a similar or identical element or feature.

DETAILED DESCRIPTION OF EXAMPLE EMBODIMENTS

It was determined by the inventors that the high-pressure flows associated with conventional sludge lancing techniques were unnecessary and that sufficient cleaning could be achieved using lower pressure fluid jets providing a flow velocity of at least about 5-10 m/sec (16-33 ft/sec). Indeed, when flushing soft, highly mobile sludge to the periphery of the steam generator, increasing the pressure far beyond that which is required to produce the noted jet velocity of 5-10 m/sec actually tends to decrease the efficiency of conventional techniques intended for removing soft, highly mobile sludge. With this discovery in mind, the inventors developed a cleaning system and method that utilizes coherent low-pressure fluid jets (nominally no more than about 0.7 MPa, but pressures of up to about 2.1 MPa may be useful) (nominally no more than about 100 psi, but pressures of up to about 300 psi may be useful), rather than conventional high-pressure fluid jets, to flush soft, highly mobile sludge to the steam generator periphery.

The coherent low-pressure fluid jets utilized in this system and method are typically able to provide sufficient flow velocities for flushing soft, highly mobile sludge from within the tube bundle and can also provide a larger cross-sectional flow area than high-pressure fluid jets produced using conventional lancing techniques. Accordingly, these coherent low-pressure fluid jets may be configured to occupy a plurality of, a majority of, or even substantially all of, the intertube gaps whereby substantially the entire surface of the intertube gap can be washed in a single pass.

This system and method utilizing improved matching of the sizing of the fluid jet and the intertube gap(s) will tend to provide both more uniform surface area coverage on the tube sheet and higher sludge removal efficiency than can be achieved with conventional high-pressure lancing techniques. For example, a plurality of these low-pressure fluid jets may be operated simultaneously in a group of adjacent intertube lanes, thereby creating a cumulative "sweeping" flow pattern that greatly reduces lateral scattering of sludge into previously cleaned areas and thereby reduce the number of "passes" necessary to achieve the same degree of cleaning and/or reduce the time required to achieve such results when compared to the performance achieved with conventional high-pressure lancing techniques.

In theory, for a given target flowrate, one needs only to increase the nozzle diameter in order to decrease the required driving pressure of a fluid jet produced during the sludge removal techniques described above. However, as the nozzle diameter is increased (as the L/D ratio is decreased), the jet that is produced by the nozzle begins to disperse more quickly after exiting the nozzle. For example, as illustrated in FIG. 1, a cleaning system 10 applying a cleaning fluid through a conduit 12 to standard nozzles 14 will tend to produce rapidly widening stream 16, rather than a coherent fluid jet. As will be appreciated by those skilled in the art, as the width of the stream increases, the contact between the stream and the tubes adjacent the intertube gap also increases. This contact with adjacent tubes results in a rapid loss of the majority of the energy and volume of the flow, thereby reducing the ability of the stream to flush sludge from the intertube gaps and increasing the scattering of the sludge into adjacent intertube gaps. For reference, because the intertube gaps in typical steam generator designs are only about 2.5 to 10 mm (0.1 to 0.4 in.) wide, and the rapidly dispersing fluid streams produced by standard nozzles will contact and be scattered by adjacent tubes, thereby reducing the cleaning flow and increasing scattering of fluid and debris into adjacent areas.

Figure 2:
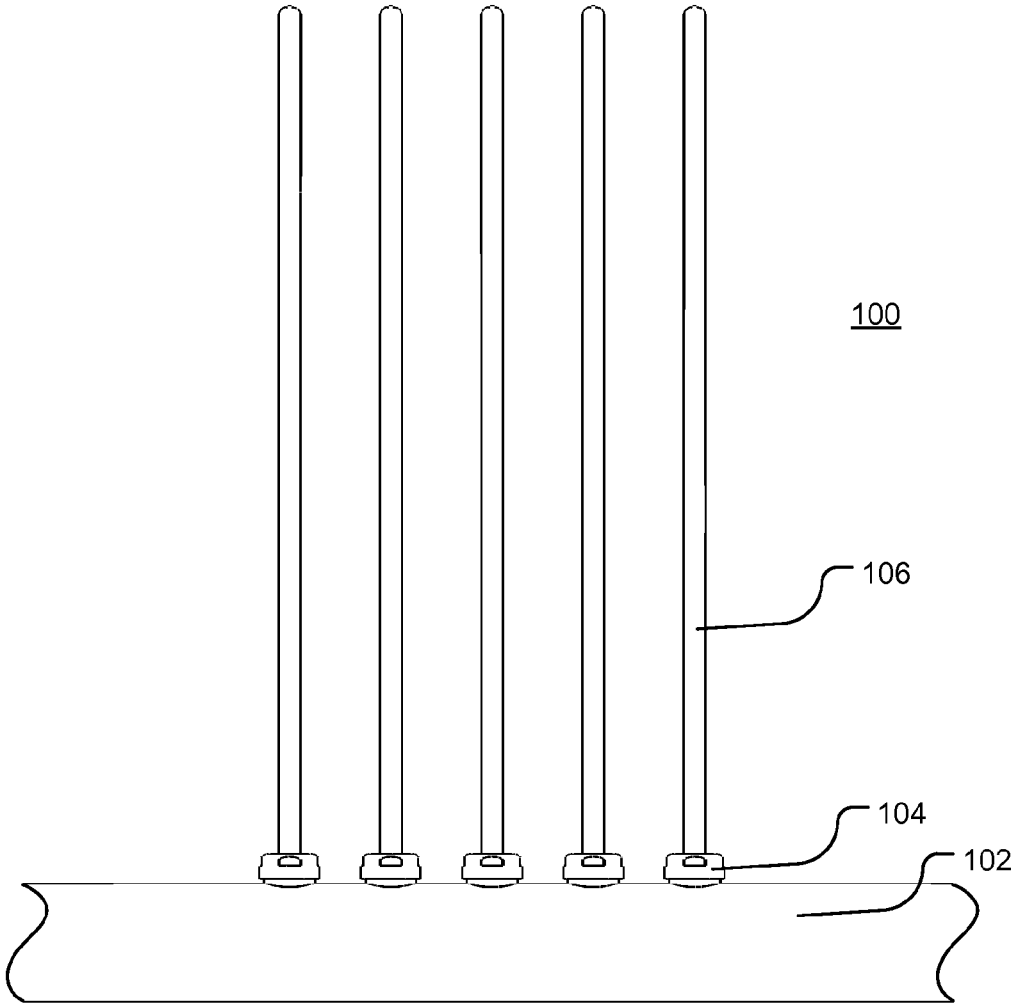
FIG. 2 illustrates a coherent flow pattern exhibited by a an array of nozzles according to an example embodiment of the invention.
Figure 3A:
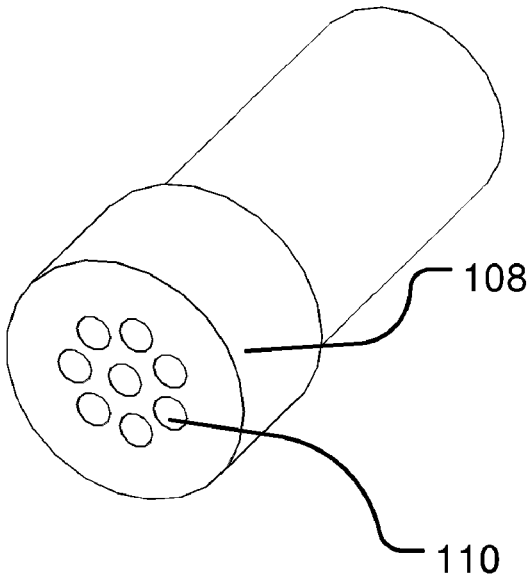
FIGS. 3A-3D illustrate several example configurations of the plurality of orifices provided in nozzles according to an example embodiment of the invention.
Figure 3B:
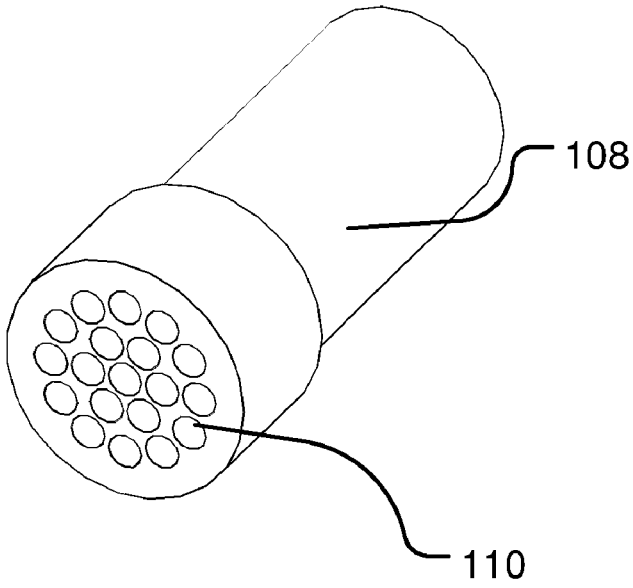
Figure 3C:
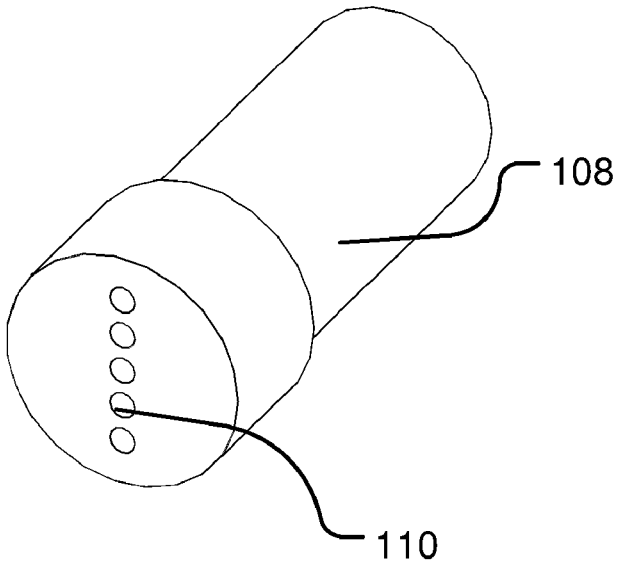
Figure 3D:
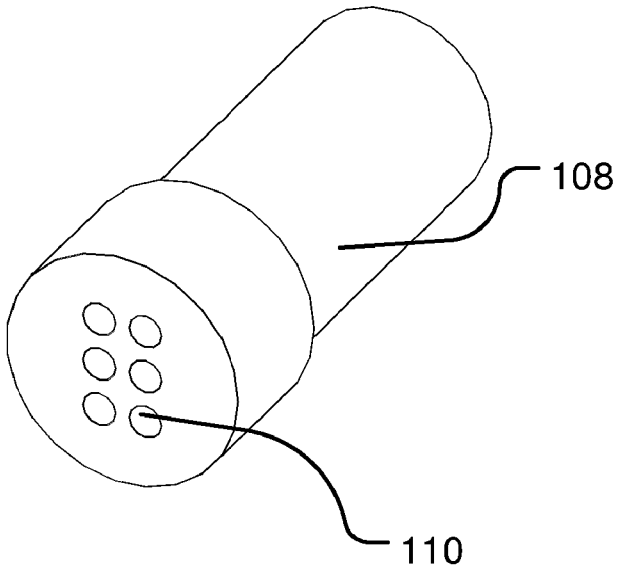

Example embodiments of an apparatus 100 according to the current invention, as illustrated in FIG. 2, incorporate one or more nozzles 104 connected to a fluid conduit 102, each of which creates a coherent, high-volume fluid jet 106 that substantially maintains its exit width, $W_e$, over a distance corresponding to the maximum distance $L_m$ between the no-tube lane and the outer perimeter of the tube bundle, i.e., the maximum length of the intertube gaps that will be cleaned with such an apparatus. For example, the width of the stream 106 at the maximum distance will typically represent no more than a 20% increase compared to the average exit width (W at $L_m \leqq 1.2\ W_e$), and will preferably exhibit no more than about a 10% increase compared to the average exit width (W at $L_m \leqq 1.1\ W_e$). In this way, energy and flow volume losses resulting from collisions between the stream(s) and the tubes lining the intertube gaps will be reduced, scattering of sludge into adjacent regions will be reduced and the efficiency of the sludge removal will be improved.

As illustrated in FIGS. 3A through 3D, the coherent jet nozzle elements 108 may be configured as a plurality of smaller holes/orifices 110, rather than one individual hole/orifice having a larger diameter/width. The coherent jet nozzles elements may be configured to provide a length to diameter (L/D) ratio that will produce a plurality of closely aligned coherent, fully-developed fluid jets. For example, it has been found that an L/D ratio of, for example, at least about 15 is sufficient to achieve the desired fluid flow profile of a plurality of aligned and coherent fluid jets. After exiting the nozzle, these individual jets coalesce to form one larger jet that remains substantially coherent over the treatment distance $L_m$. As will be appreciated by those skilled in the art, improved cleaning can be achieved when the treatment distance $L_m$ approaches or surpasses, for example, the maximum distance between the no-tube lane in which the nozzles will be positioned and the steam generator shell, i.e., a distance approximately equal to the radius of a cylindrical steam generator with a no-tube lane provided across a diameter. As will also be appreciated by those skilled in the art, systems in which the treatment distance $L_m$ is less than the maximum length of an intertube gap can still provide substantially improved cleaning relative to conventional sludge lancing or other systems that cannot produce substantially coherent streams by reducing the stream and sludge scattering.

Figure 4:
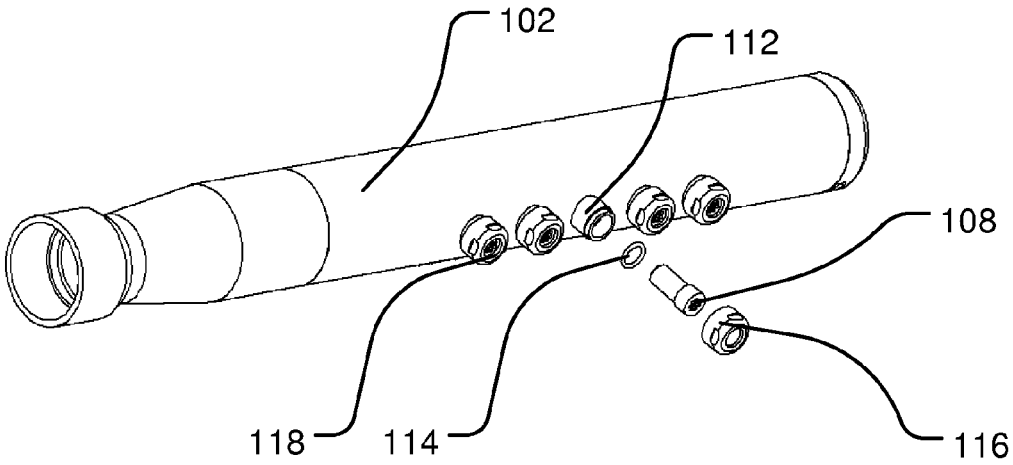
FIG. 4 illustrates an example configuration of the nozzles according to FIGS. 3A-3D in conjunction with a fluid distribution shuttle.

As illustrated in FIG. 4, the fluid conduit 102 may be provided with a series of structures or fittings 112 for receiving the nozzle assemblies 108. The nozzle assemblies may be attached to the fittings 112 using an O-ring 114 or other structures to provide a substantially fluid-tight attachment and then held in place with a cap or fitting 116 configured to cooperate with the fittings 112 and/or the nozzle assembly to provide nozzles along a portion of the conduit 102.

Figure 5:
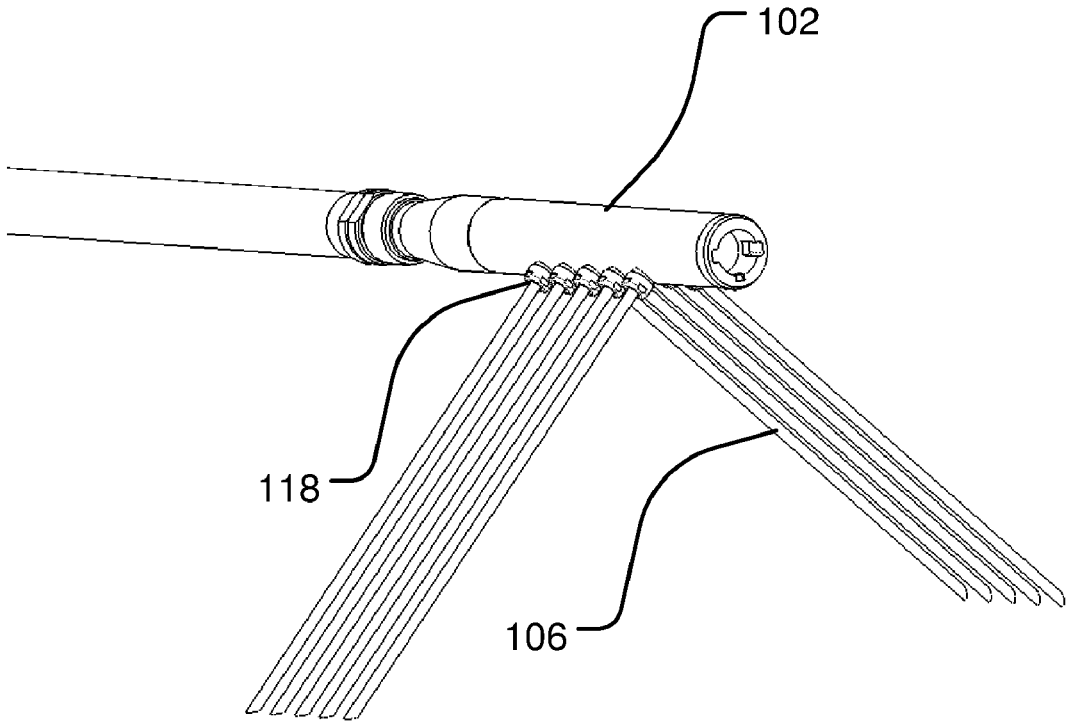
FIG. 5 illustrates general operation of an assembly including nozzles and a fluid distribution shuttle according to FIG. 4.
Figure 6A:
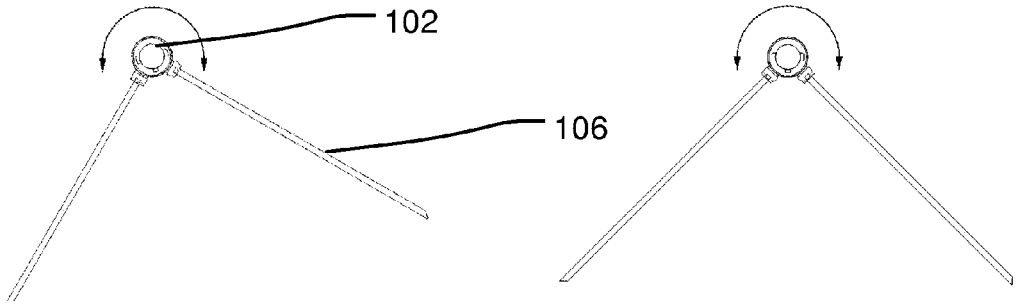
FIGS. 6A and 6B illustrate rotation of an assembly including nozzles and a fluid distribution shuttle according to FIG. 4 about a main longitudinal axis of the fluid distribution shuttle.
Figure 6B:
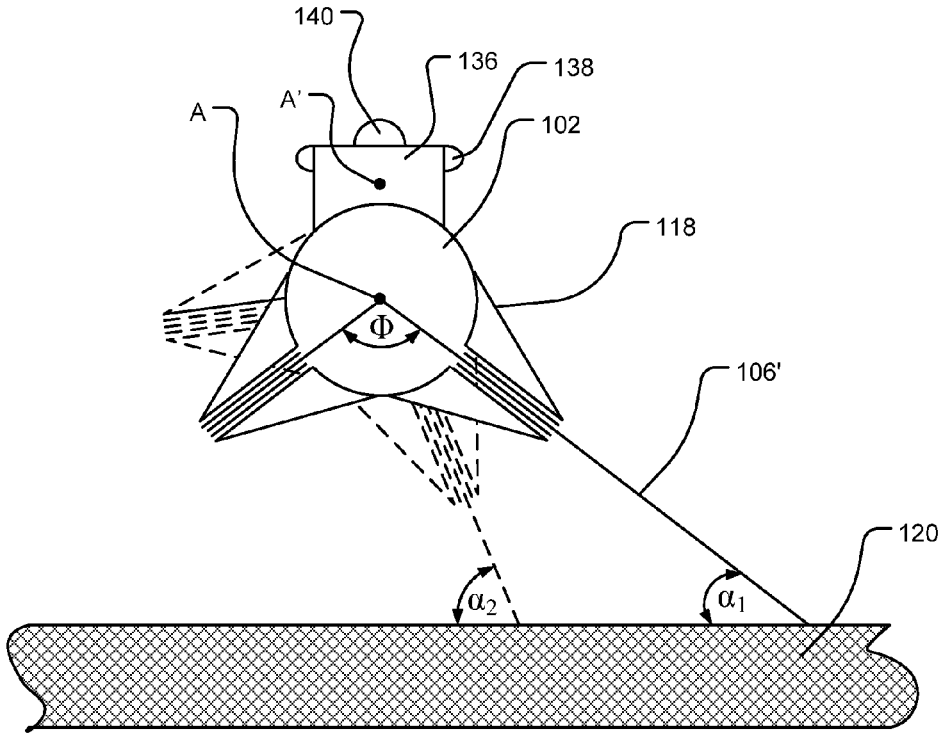

As illustrated in FIG. 5, groups of nozzles may be provided on various portions of the conduit 102 to allow the resulting fluid streams 106 to be directed in different directions. As illustrated in FIG. 6A, the conduit 102, or a forward portion of the conduit which can be referred to as a shuttle, can be configured for at least partial rotation, thereby imparting a "sweeping" action to the fluid streams 106. As illustrated in FIG. 6B, corresponding nozzles provided in separate groups of nozzles may be spaced along the circumference of the shuttle by an angle $\Phi$ that may, of course, vary among the pairs of corresponding nozzles. As illustrated in FIG. 6B, rotation of the shuttle will alter the orientation of the fluid stream 106' with respect to the cleaned surface 120 between first $\alpha 1$ and second $\alpha 2$ angles. As will be appreciated by those skilled in the art, these angles may be selected to provide for a "sweeping" action along all or at least some portion of the intertube lane along which the fluid stream is being directed.

As will also be appreciated by those skilled in the art and as illustrated in FIG. 6B, the conduit or shuttle portion of the apparatus may be associated with additional devices, for example, carriage 136, that provide the mechanical support for the conduit as well as additional mechanisms to provide for the indexing 138, positioning and rotating 140 functions as necessary to effect the cleaning method. The indexing mechanism 138 may include, for example, stepper motors, sensors and/or gearing that provides a sufficient degree of accuracy whereby the nozzles can be aligned with designated intertube lanes. The rotating mechanisms 140 may include, for example, belts, gears and sensors for controlling the rotation of the carriage and/or the rotation of the shuttle within the carriage, about one or more axes A, A' to impart a "sweeping" motion to the cleansing fluid streams.

As those skilled in the art are expected to be familiar with the design and implementation of a range of mechanisms that can be used to achieve the desired functionality, these mechanisms are not illustrated in any particular detail. Indeed, the particular mechanisms utilized will be selected, at least in part, based on application-specific considerations including, for example, size, weight, available space, availability of utilities, cleanliness, radiation resistance of materials and design durability.

Figure 7:
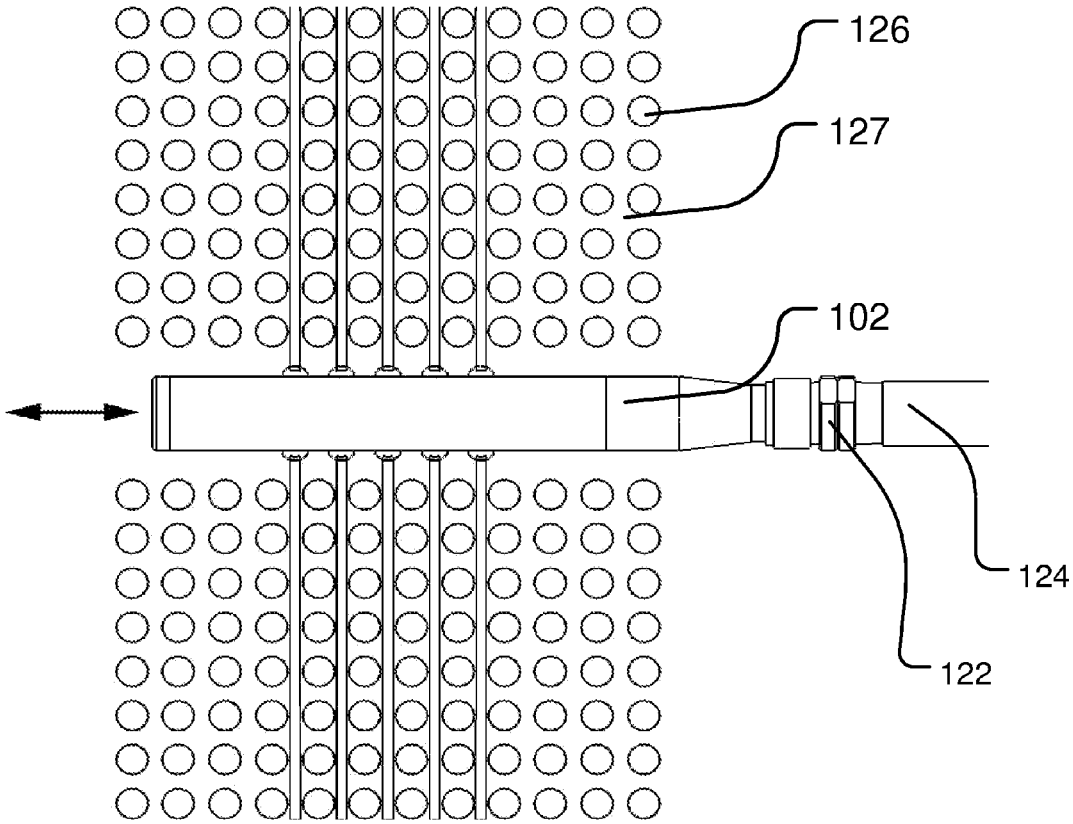
FIG. 7 illustrates an example positioning of an assembly including nozzles and a fluid distribution shuttle according to FIG. 4 along a no-tube lane provided within a tube bundle.
Figure 9:
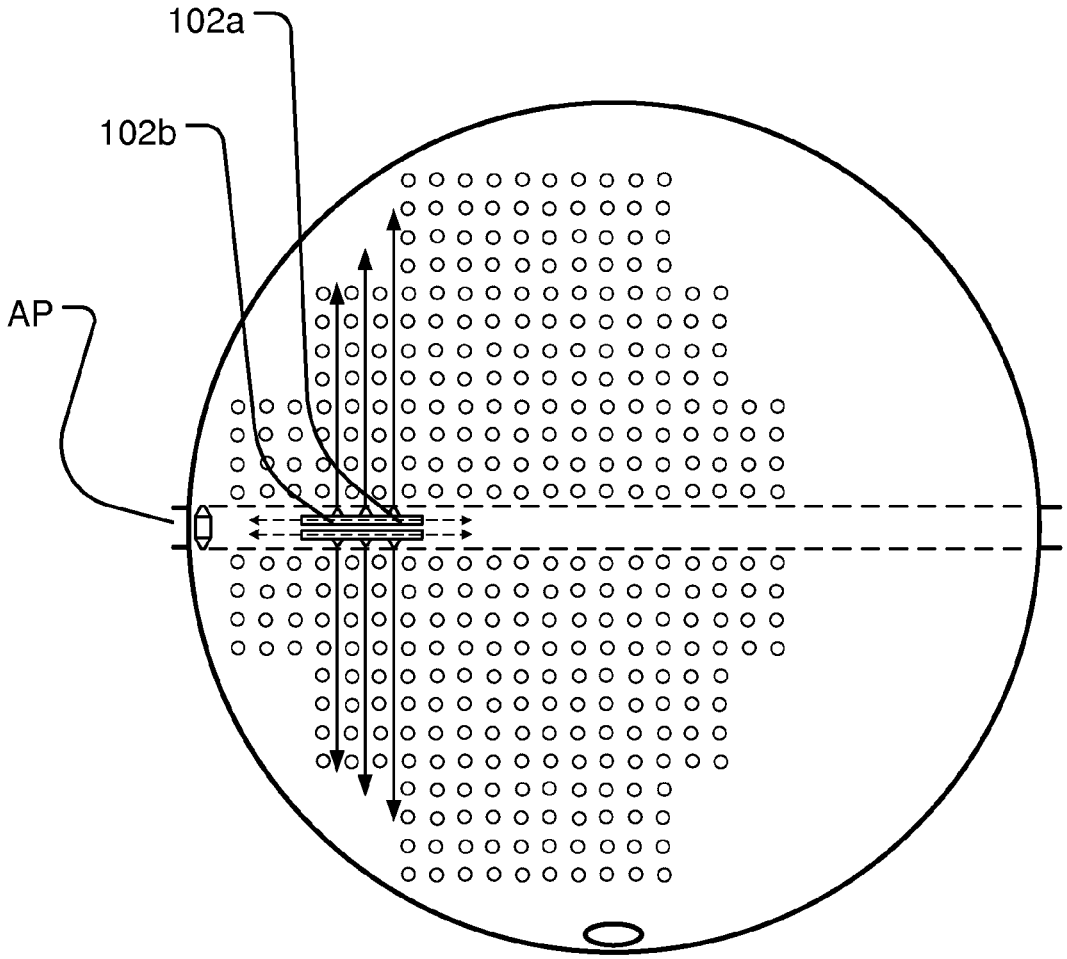
FIG. 9 illustrates an example embodiment of a cleaning apparatus according to the invention in which the nozzles directed down opposing intertube lanes are provided on separate conduits.
Figure 10A:
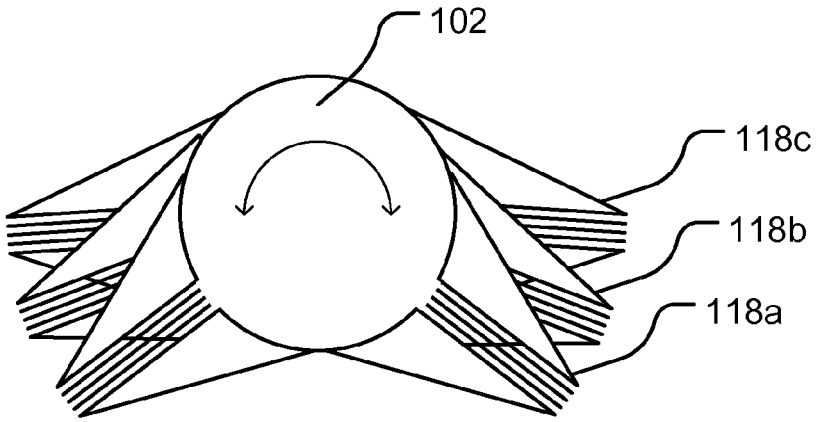
FIGS. 10A and 10B illustrate a cross-sectional and a side view, respectively, of a nozzle arrangement on a single conduit wherein the nozzles are offset from adjacent nozzle(s) to direct the flow toward different portions of the adjacent intertube lanes.
Figure 10B:
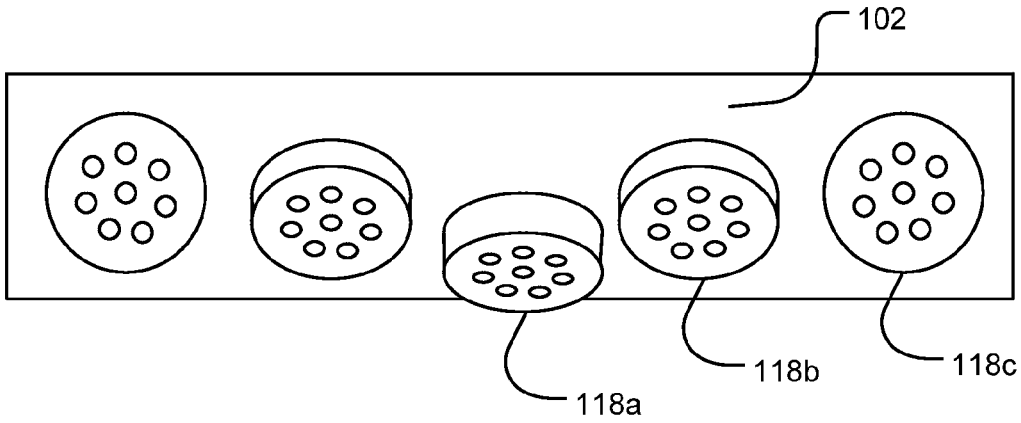
Figure 11:
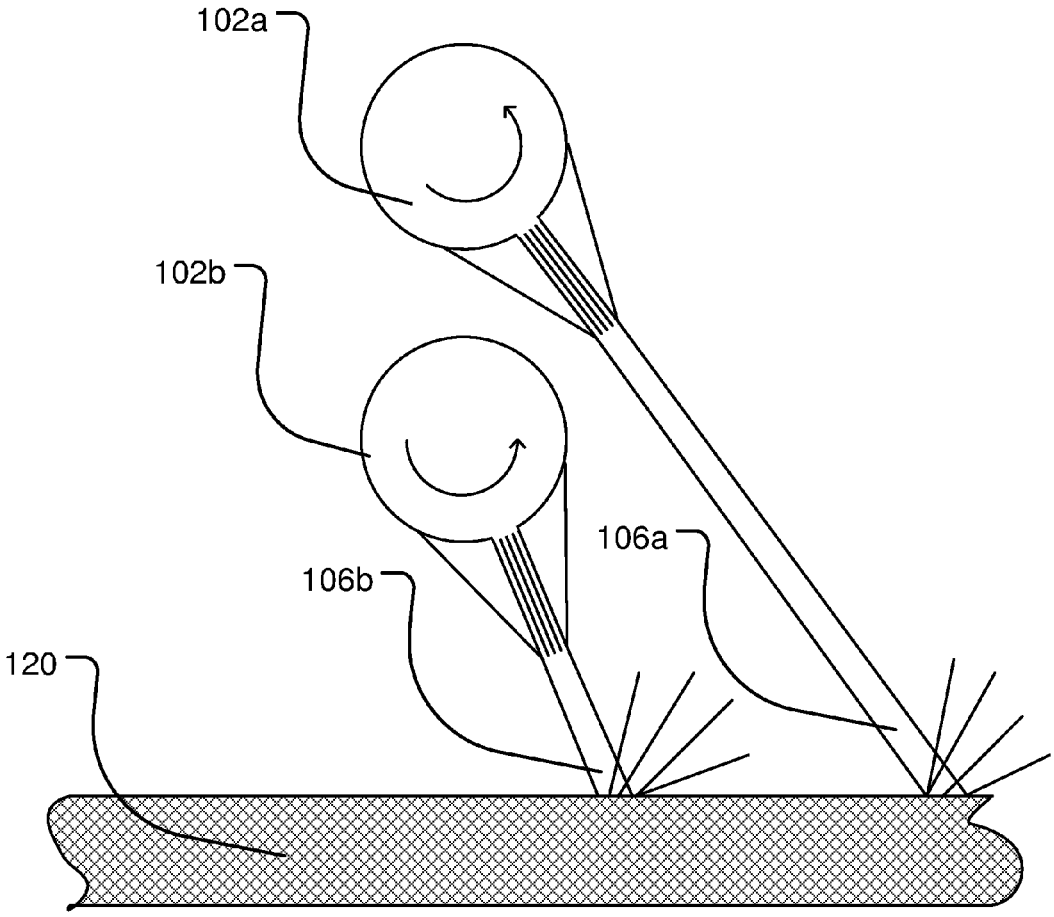
FIG. 11 illustrates a stacked configuration in which nozzles provided on two separate conduits are directed to different portions of a single intertube lane to provide both a primary and a secondary cleansing stream.

As illustrated in FIG. 7, the conduit or shuttle 102 may be indexed forward and backward through a no-tube lane in order to direct the fluid streams along the intertube (or intermember) lanes 127 defined by the arrangement of the obstructing tubes (or members) 126. As will be appreciated, particularly with respect to rotation, the forward portion of the conduit, the shuttle, may be configured in a manner substantially different than the rearward portion 124 with the two portions being attached through an appropriate fitting or fittings 122. As illustrated in FIGS. 9 and 11, the conduit or shuttle portion of the apparatus is not limited to a single tube configuration and may include two or more conduits, for example, 102*a*, 102*b*, arranged, for example, in a side-by-side (FIG. 9) or over-and-under (FIG. 11) or other configuration. As illustrated in FIG. 11, for example, the configuration allows two or more fluid streams to be applied simultaneously to different regions of a single intertube lane, thereby improving the cleaning process. As illustrated in FIGS. 10A and 10B, the nozzles within a single group, 118*a*, 118*b*, 118*c*, may have different circumferential positioning in order to apply the fluid streams to different portions of adjacent intertube lanes, thereby reducing the scattering and improving the cleaning process.

Figure 8:
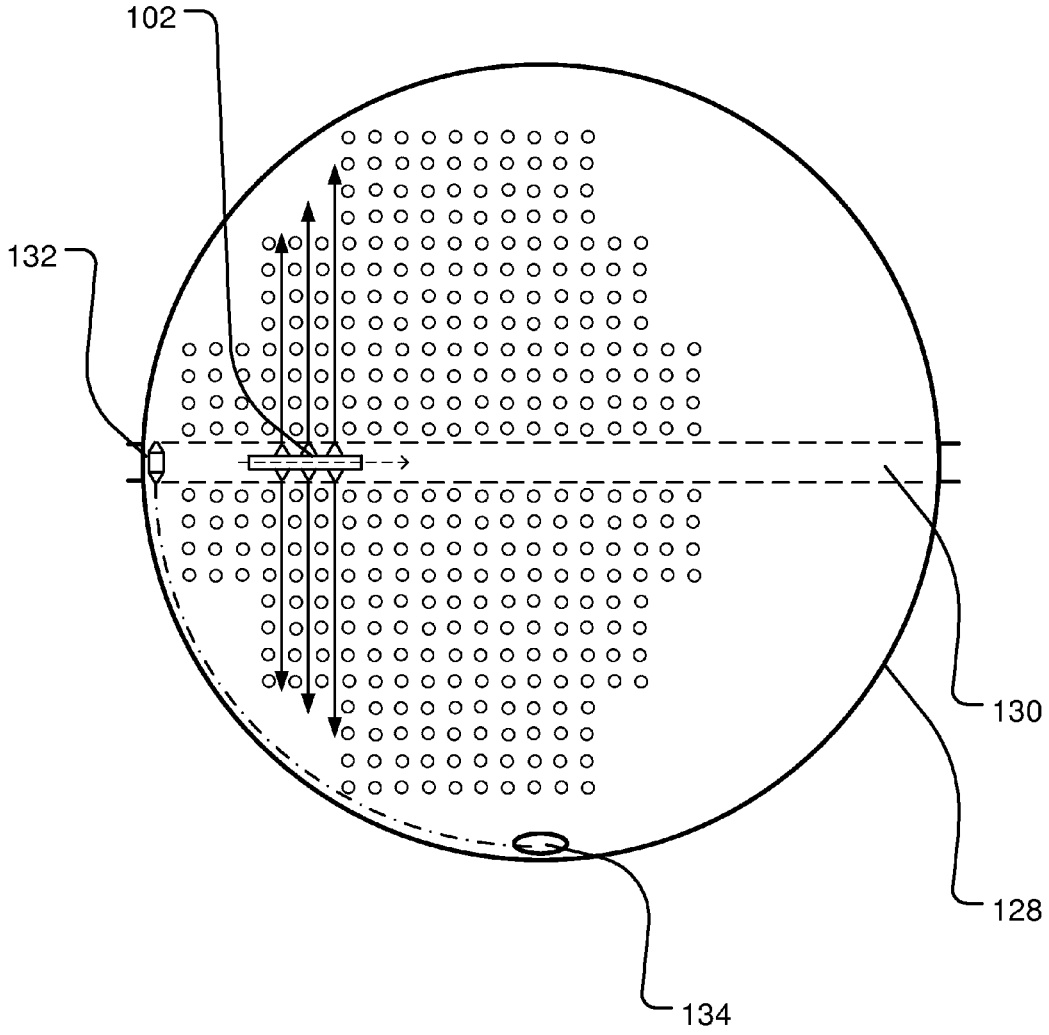
FIG. 8 illustrates an application of a cleaning apparatus according to an example embodiment of the invention configured to establish a circumferential flow that will tend to move the cleansing solution toward a vacuum extractor device.

Example embodiments of cleaning apparatus according to the invention may also incorporate additional structures for establishing a peripheral flow system such as described in Hickman et al.'s U.S. Pat. No. 4,079,701, the contents of which are hereby incorporated, in its entirety, by reference, that will tend to direct the flow(s) exiting the tube bundle along the outer wall of the vessel toward an extraction point as illustrated, for example, in FIGS. 8 and 9. As illustrated in FIGS. 8 and/or 9, the cleaning apparatus may be inserted into the heat exchanger through an access port AP and advanced along a no-tube lane 130 and may provide additional nozzles 132 for establishing a circumferential flow along the outer wall 128 that will tend to sweep the removed debris toward an extraction point 134, for example, a drain or vacuum opening. As will be appreciated by those skilled in the art, however, the use of the low-pressure, high-volume (for example, 190 liters/min. (about 50 gal./min.) or more) cleaning jets removes many of the constraints imposed by the use of high pressure and allows the nozzles to be provided in a range of offset and adjustable configurations to better match the pitch of the nozzles to the pitch of the intertube lanes to be cleaned. Similarly, a plurality of nozzles may be provided with different arcuate offsets for use in combination with rotation of the distribution channel to provide a differential "sweeping" flow through a series of adjacent intertube lanes and thereby improve the effectiveness of the cleaning operation in removing sludge and silt.

For example, the apparatus can be configured so that two sets of nozzles operate simultaneously from opposing access holes in order to create a flow pattern directing the material toward associated extraction apparatus, typically suction equipment, as described in U.S. Pat. Nos. 4,492,186 to Helm and 4,848,278 to Theiss, the contents of which are hereby incorporated, in their entirety, by reference. The apparatus could also be used in conjunction with an adjustable suction device that can be appropriately positioned to maximize the removal of sludge flushed from the tube bundle by the primary fluid jets as described in U.S. Pat. No. 4,492,186. When used in conjunction with a peripheral flow system as described in U.S. Pat. No. 4,079,701 to Hickman, the coherent jet nozzles according to the example embodiments of the invention may be used both to produce the primary fluid jets and to enhance the efficiency of peripheral flow.

As will be appreciated by those skilled in the art, the cleaning apparatus may include an indexing mechanism by which the coherent nozzles provided on the cleaning apparatus may be aligned with the intertube lanes or gaps that are to be cleaned as illustrated, for example, in FIG. 7. This indexing mechanism may be integrated with one or more valves for interrupting the flow of the cleaning solution during movement of the cleaning apparatus. Similarly, the individual coherent nozzles may be provided with valves for interrupting the flow of the cleaning solution through a nozzle or a group of nozzles depending on the orientation of the nozzles (when, for example, as the nozzles approach a horizontal orientation or are otherwise not oriented for directing a stream of cleaning solution onto a horizontal surface in the intertube lane.

Those skilled in the art will also appreciate that although water may provide sufficient sludge removal efficiency, aqueous solutions of various chemical additives, for example, traditional chemical cleaning solvents, Advanced Scale Conditioning Agents ("ASCAs"), dispersants, surfactants, solvents, viscosity modifiers, and abrasives, may also be used as the fluid media with embodiments of the current invention in order to enhance removal effectiveness and efficiency. In particular, chemical treatments (e.g., traditional chemical cleaning solvents, ASCAs, etc.) may be utilized to flush sludge from intertube lanes, and also to dissolve sludge that is difficult to remove using mechanical cleaning techniques, including hard sludge, as well as "shadow" sludge that is shielded from mechanical removal by steam generator tubing.

Chemical treatments (e.g., dispersants, viscosity modifiers, etc.) may also by used to directly enhance the mechanical efficiency of sludge removal by increasing the time that loose sludge can be suspended in the fluid media. Note that the temperature of the fluid media may'also be controlled in order to adjust the viscosity of the fluid media and/or the sludge dissolution rate (if chemical additives are used). As will also be appreciated, various combinations of water and aqueous chemical solutions can be sequentially ejected from the nozzles to, for example, remove the bulk of overlying loose sludge before chemically treating the underlying hard sludge, and then switching to a water rinse cycle to remove any additional loosened sludge or scale.

While the invention has been particularly shown and described with reference to certain example embodiments thereof, it will be understood by those of ordinary skill in the art that various changes in form and details may be made therein without departing from the spirit and scope of the invention as defined by the following claims.

We claim:

1. A method for low-pressure cleaning of horizontal surfaces between vertical members arranged in a regular array comprising:

introducing a cleaning apparatus into an opening provided adjacent to the regular array;

aligning a coherent flow nozzle provided on the cleaning apparatus with an intermember lane defined between two adjacent rows of the vertical members;

ejecting a coherent jet of a cleaning solution through the coherent flow nozzle; and sweeping the coherent jet from a proximal portion of the intermember lane to a distal portion of the intermember lane, thereby removing material from the intermember lane;

wherein the coherent flow nozzle comprises an orifice that has an orifice bore length to orifice diameter ratio of at least about 15, and ejecting the coherent jet comprises ejecting the coherent jet from the orifice.

2. The method for low-pressure cleaning according to claim 1, wherein:

cleaning solution is ejected from the coherent flow nozzle at a pressure no greater than 2.1 MPa.

3. The method for low-pressure cleaning according to claim 1, wherein:

cleaning solution is ejected from the coherent flow nozzle at a pressure no greater than 2.1 MPa and a flow velocity of at least about 5 m/s.

4. The method for low-pressure cleaning according to claim 1, wherein:

the step of aligning the coherent flow nozzle with the intermember lane includes detecting at least one of the intermember lane and a member adjacent the intermember lane using a sensor selected from a group consisting of optical sensors, mechanical sensors, ultrasonic sensors and capacitive sensors.

5. The method for low-pressure cleaning according to claim 1, wherein:

the step of aligning the coherent flow nozzle with the intermember lane includes adjusting a separation spacing between a plurality of adjacent coherent flow nozzles to correspond to a characteristic pitch defined by the regular array.

6. The method for low-pressure cleaning according to claim 1, further comprising:

collecting and removing the cleaning solution with removed material as it exits the regular array.

7. The method for low-pressure cleaning according to claim 1, wherein:

the coherent jet has an initial average width of $W_e$ and a final average width $W_m$ measured at a maximum cleaning distance, and wherein the $1.2\ W_e \leqq W_m$.

8. The method for low-pressure cleaning according to claim 7, wherein the maximum cleaning distance is at least $100\ W_e$.

9. The method for low-pressure cleaning according to claim 1, wherein the coherent jet has an initial average width of $W_e$ which corresponds substantially to a width of the intermember lane.

10. The method for low-pressure cleaning according to claim 1, wherein ejecting the coherent jet comprises ejecting the coherent jet from an orifice in the coherent flow nozzle as a fully-developed low pressure fluid jet.

11. The method for low-pressure cleaning according to claim 1, wherein:

the coherent flow nozzle comprises an orifice that has an orifice bore length to orifice diameter ratio sufficient to produce a fully-developed low pressure fluid jet, and ejecting the coherent jet comprises ejecting the coherent jet from the orifice.

12. The method for low-pressure cleaning according to claim 1, wherein:

the coherent flow nozzle comprises a closely-aligned, closely spaced plurality of orifices, and ejecting the coherent jet comprises ejecting a plurality of fully-developed coherent fluid jets from respective ones of the plurality of orifices.

13. The method for low-pressure cleaning according to claim 12, wherein the plurality of fully-developed coherent fluid jets coalesce to produce a single larger coherent fluid jet that comprises the coherent jet.

14. The method for low-pressure cleaning according to claim 1, wherein:

the coherent flow nozzle comprises a closely-aligned, closely spaced plurality of orifices, each of the plurality of orifices has an orifice bore length to orifice diameter ratio of at least about 15, and ejecting the coherent jet comprises ejecting the coherent jet from the plurality of orifices.

15. The method for low-pressure cleaning according to claim 14, wherein:

ejecting the coherent jet from the plurality of orifices comprises ejecting separate and discrete, fully-developed coherent fluid jets from respective ones of the plurality of orifices, and the separate and discrete coherent fluid jets coalesce to produce a single larger coherent fluid jet that comprises the coherent jet.

16. The method for low-pressure cleaning according to claim 1, further comprising:

stopping ejection of the coherent jet;

moving the cleaning apparatus along the opening such that the coherent flow nozzle is aligned with another intermember lane defined between two adjacent rows of the vertical members;

ejecting a second coherent jet of a cleaning solution through the coherent flow nozzle; and sweeping the second jet from a proximal portion of the another intermember lane to a distal portion of the another intermember lane, thereby removing material from the another intermember lane.

17. The method for low-pressure cleaning according to claim 1, wherein:

the coherent flow nozzle comprises a first coherent flow nozzle;

the intermember lane comprises a first intermember lane;

the coherent jet comprises a first coherent jet;

the cleaning apparatus comprises a second coherent flow nozzle; and the method further comprises:

aligning the second coherent flow nozzle with a second intermember lane defined between two adjacent rows of the vertical members, ejecting a second coherent jet of the cleaning solution through the second coherent flow nozzle, and sweeping the second coherent jet from a proximal portion of the second intermember lane to a distal portion of the second intermember lane, thereby removing material from the second intermember lane.

18. The method for low-pressure cleaning according to claim 1, wherein:

the vertical members comprise tubes of a heat exchanger, the horizontal surfaces comprise horizontal surfaces of a tube support plate of the heat exchanger, and the intermember lane comprises an intertube lane.

19. A method for low-pressure cleaning of horizontal surfaces between vertical members arranged in a regular array comprising:

introducing a cleaning apparatus into an opening provided adjacent the regular array;

aligning each of a plurality of coherent flow nozzles provided on the cleaning apparatus with a respective intermember lane defined between two adjacent rows of the vertical members, each of the plurality of coherent flow nozzles comprising a plurality of closely aligned and closely spaced orifices, each orifice having an orifice bore length to orifice diameter ratio sufficient to produce a fully-developed low-pressure fluid jet;

ejecting a separate and distinct coherent fluid jet of a cleaning solution through each individual one of the plurality of coherent flow nozzles such that with respect to each nozzle, fluid jets emitted from the plurality of orifices coalesce to produce a single larger coherent fluid jet ejected from the respective nozzle; and sweeping the jet from a proximal portion of the respective intermember lanes to a distal portion of the respective intermember lanes, thereby removing material from the respective intermember lanes.

* * * * *